United States Patent [19]

Lee

[11] Patent Number: 4,683,730

[45] Date of Patent: Aug. 4, 1987

[54] SHORT-TERM FUR SECURITY SYSTEM

[76] Inventor: Michaelina Lee, 6236 Trancas Canyon Rd., Malibu, Calif. 90265

[21] Appl. No.: 754,797

[22] Filed: Jul. 12, 1985

[51] Int. Cl.[4] ..... E05B 69/00

[52] U.S. Cl. ..... 70/59; 70/49; 211/4; 2/65

[58] Field of Search ..... 70/59, 60, 57, 58, 16, 70/18, 49; 211/4, 7; 223/85, 88, 92; 150/102; 190/101, 102; 2/65

[56] References Cited

U.S. PATENT DOCUMENTS

| | | | |
|---|---|---|---|
| 404,544 | 6/1889 | James et al. | 70/16 |
| 749,176 | 1/1904 | Eyres | 223/92 |
| 1,043,351 | 11/1912 | Paskell | 211/4 |
| 1,534,265 | 4/1925 | Harrison | 223/88 |
| 1,800,606 | 4/1931 | David | 223/92 |
| 2,350,799 | 6/1944 | Morris | 70/59 |
| 2,783,926 | 3/1957 | Wise | 150/102 |
| 3,264,851 | 8/1966 | Kimball | 70/58 |
| 3,399,855 | 9/1968 | Shirai | 70/59 |
| 3,882,700 | 5/1975 | Dunlap et al. | 70/59 |
| 3,885,674 | 5/1975 | Rosenberg et al. | 70/59 |
| 4,014,374 | 3/1977 | Douglas, Sr. | 150/102 |
| 4,024,736 | 5/1977 | DeMichieli | 70/16 |
| 4,067,290 | 1/1978 | Hartley | 150/102 |
| 4,069,691 | 1/1978 | Simpson | 211/4 |
| 4,185,361 | 1/1980 | Stuart | 70/58 |
| 4,231,586 | 11/1980 | Krause | 70/58 |
| 4,438,877 | 3/1984 | Jackson | 70/58 |

FOREIGN PATENT DOCUMENTS

| | | | |
|---|---|---|---|
| 89074 | 1/1922 | Austria | 70/59 |
| 157854 | 1/1905 | Fed. Rep. of Germany | 211/4 |
| 283088 | 6/1913 | Fed. Rep. of Germany | 70/59 |

*Primary Examiner*—Thomas J. Holko
*Assistant Examiner*—Suzanne L. Dino
*Attorney, Agent, or Firm*—Townsend and Townsend

[57] ABSTRACT

A short-term security system according to the present invention utilizes first and second mutually engageable locking members affixed to the garment at spatially separate locations (e.g., opposite sleeves) so that the garment may be locked around a stationary object such as the arm of a chair, with the garment forming a closed loop.

8 Claims, 3 Drawing Figures

SHORT-TERM FUR SECURITY SYSTEM

The present invention relates generally to garment security, and more specifically to a system for securing garments to fixed structures.

BACKGROUND OF THE INVENTION

The message that crime doesn't pay seems not to have been adequately communicated to those unscrupulous sorts who form the chain of commerce in stolen fur garments. While it seems almost trite to cite the statistics of skyrocketing crime rates, it is nevertheless important to keep sight of the tremendous burden such crimes impose on society. The theft of a prized fur garment, even if carried out in a non-violent manner, takes a psychic toll on its victim. While the economic loss to a given victim may be offset by theft insurance, this merely spreads the loss among all of those who are forced to pay ever-increasing insurance premiums.

In recent years, the problem of theft from clothing stores has led to a bewildering array of devices and systems designed to curb such theft. One approach seeks to prevent removal from the rack except by authorized store personnel. This approach is exemplified by a system utilizing a chain passing through the garment sleeve, one end of the chain being fastened to the rack, the other end carrying an oversized hoop to prevent withdrawal from the sleeve. An alternate approach is to prevent removal of the garment from the store. This is accomplished by clamping a small radio transmitter or similar device to each garment, and providing an appropriate detector at each store exit.

Unfortunately, once the garment has left the store, the elaborate security precautions are no longer in force, and the garment is subject to theft from the new owner. This condition continues while the garment is in the owner's home, and while the garment is with the owner away from home, whether for long periods, as for example when the owner is traveling, or for short periods, as for example when the owner is attending the theater. The security systems that are presumably effective to prevent theft of garments from the stores are generally not suitable for home use, since they require specialized racks or possibly special electronic surveillance equipment. Even if the owner of an expensive fur garment sees to it that her home is equipped with a specialized rack such as used in stores, she can be relatively assured that the hotel in which she stays, or the theater cloakroom in which she would like to leave her coat will not be so equipped.

Thus, the traffic in stolen furs continues and the owners of expensive fur garments accept the payment of ever-increasing insurance premiums as being the inevitable lesser of two evils.

SUMMARY OF THE INVENTION

The present invention provides the garment owner with short-term security as needed. The system is simple, inexpensive, and is easily adapted to a wide range of possible environments.

A short-term security system according to the present invention utilizes first and second anchor elements affixed to the garment at spatially separate locations (e.g., opposite sleeves) and a lock adapted to lock the anchor elements together so that the garment may be locked around a stationary object such as the arm of a chair, with the garment forming a closed loop. In the context of a fur garment with a fabric lining inside the skin surface of the fur, the anchor elements are preferably mounted to small brackets sewn to the skin, with the anchor elements protruding through the lining. The lock may be a padlock that is either separate or mounted to one anchor element and engageable with the other. Alternately, the lock may comprise first and second mutually engageable locking members mounted to the first and second anchor elements, respectively. The locking members are preferably encased within small fabric pouches to protect the lining and avoid discomfort to the wearer. Each mounting bracket is preferably of a hinged configuration with a ring having a portion defining the hinge pin and another portion defining the anchor element.

The short-term security system according to the present invention has the advantage that it is unobtrusive, and yet is always available for use. The hinged mounting bracket is advantageous since it is flexible. Also, the hingedly connected portions may assume an aligned position for easy insertion through a small hole in the lining, and an opposed position for mounting to the skin.

For a further understanding of the nature and advantages of the present invention, reference should be made to the remaining portion of the specification and to the attached drawings.

DETAILED DESCRIPTION OF THE INVENTION

Figure 1:
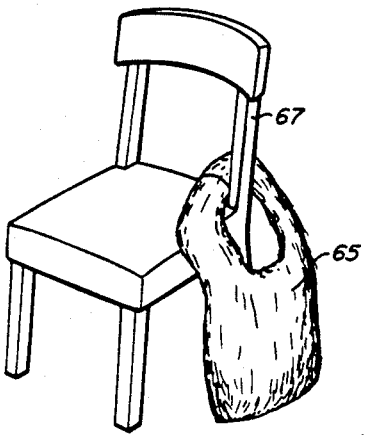
FIG. 1 is a perspective view illustrating the use of a short-term security system according to the present invention.

FIG. 1 is a perspective view illustrating the use of a short-term security system according to the present invention for securing a garment 65 to a convenient fixed structure such as a chair 67. This is accomplished by locking spatially separate portions of the garment together to form a closed loop that surrounds an appropriate portion of the fixed structure to prevent separation of the garment.

Figure 2:
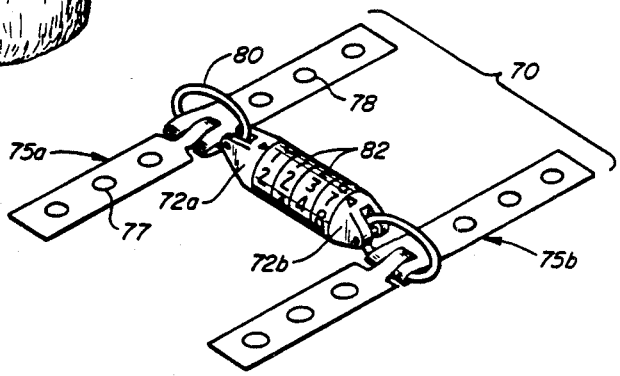
FIG. 2 is an isometric view of the short-term security system.

FIG. 2 is an isometric view illustrating a short-term security system 70 suitable for use as shown in FIG. 1. Broadly, system 70 comprises first and second mutually engageable locking members 72*a* and 72*b*, and first and second mounting brackets 75*a* and 75*b* for mounting the locking members to respective spatially separated portions of garment 65. In most instances, garment 65 will be a sleeved garment such as a fur coat or jacket, with the locking members being mounted in opposite sleeves.

Mounting brackets 75*a* and 75*b* are typically of identical construction, and only bracket 75*a* will be described. Bracket 75*a* is of hinged construction having first and second hinge portions 77 and 78, and a ring 80. Hinge portions 77 and 78 are generally strip-like, each approximately 1.5–2 inches by $\frac{1}{4}$–$\frac{1}{2}$ inch and having a tubular end region to accommodate a common hinge pin. Ring 80 passes through the aligned tubular end regions of hinge portions 77 and 78 so that a portion defines the hinge pin; a remaining portion of the ring defines an anchor element to which locking member 72*a* is mounted.

Locking members 72a and 72b are preferably cooperating portions of a tubular combination lock having a plurality of disks 82 which must all be aligned in a particular way to permit separation of the two cooperating portions. Each locking member is slotted to receive a respective ring, and includes a pin for retaining the ring.

Figure 3:
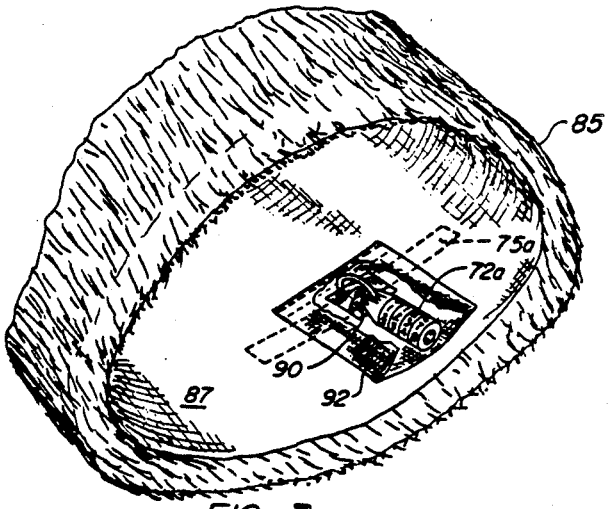
FIG. 3 is a perspective view illustrating the mounting of one of the locking members in a sleeve of a garment.

As discussed above, locking members 72a and 72b are typically mounted within opposite sleeves of a garment. FIG. 3 is a perspective view illustrating a preferred mounting regime for locking member 72a and mounting bracket 75a within a sleeve 85. Typically, the fur garment has a lining 87 on the skin side 90 of the fur. Hinge portions 77 and 78 are sewn directly to the skin side of the fur, with ring 80 protruding through the lining so that locking member 72a is located on the side of the lining remote from the fur. Prior to sewing hinge portions 77 and 78 to the skin side of the fur, the fur is "built up" at the location of attachment by sewing a piece of interfacing to the skin side. This strengthens the fur and protects it from the bracket. A 1-inch by 4-inch piece of interfacing is suitable. A padded pouch 92 is sewn to lining 87 and surrounds locking member 72a so that when system 70 is not in use, the locking member is completely surrounded and thus does not snag on the wearer's clothing or cause an unpleasant sensation to the wearer.

The hinged configuration of the mounting brackets facilitates installation which proceeds as follows. Hinge portions 77 and 78 are first aligned in a parallel or closed position so that the bracket may be easily pushed through a small hole in the lining. The hinge portions are then spread apart into an opposed configuration and sewn to the built up portion of the fur. The hinged configuration, in addition to facilitating the insertion, has the advantage that a relatively large mounting area is provided while maintaining flexibility. Mounting within the sleeves is typically done with the brackets extending transversely.

In summary, it can be seen that the present invention provides short-term security for the owner of a garment such as a fur coat or jacket. The security system is unobtrusive, and yet the wearer of the garment is never in a situation where the system is unavailable.

While the above provides a full and complete description of the preferred embodiments of the invention, various modifications, alternate constructions, and equivalents may be employed without departing from the true spirit and scope of the invention. For example, a small padlock could be used in cooperation with the two rings to provide the same operation as the mutually engageable locking members. Therefore, the above description and illustration should not be construed as limiting the scope of the invention which is defined by the appended claims.

I claim:

1. A security system for preventing theft of a garment comprising:

first and second mutually engageable locking members; and first and second bracket members for mounting said first and second locking members to spatially separated portions of said garment so that said garment may be secured to a fixed structure by engaging said first and second locking members so that said garment forms a closed loop around said fixed structure, each one of said bracket members comprising first and second hinge portions having an aligned configuration and an opposed configuration for mounting to the garment, and a member having a portion defining a hinge pin for hingedly fastening said first and second hinge portions together, and further having a portion defining an anchor for the respective locking member.

2. The invention of claim 1, and further comprising first and second pouches, each adapted to be sewn to a lining of the garment to surround a respective unengaged locking member to protect the lining and prevent user discomfort.

3. In combination with a garment, a security system for preventing theft of said garment comprising:

first and second mutually engageable locking members; and means for mounting said first and second locking members to spatially separated portion of said garment so that said garment may be secured to a fixed structure by engaging said first and second locking members so that said garment forms a closed loop around said fixed structure;

wherein said garment is a fur garment comprising a skin and a lining, wherein said mounting means comprises first and second bracket members adapted to be sewn to said skin, wherein said mounting means is configured to permit said locking members to be located on the side of said lining remote from said skin, and wherein at least one of said bracket members comprises first and second hinge portions having an aligned configuration for insertion through a small hole on said lining, and an opposed configuration for mounting to said skin, and a ring defining a hinge pin for hingedly fastening said first and second hinge portions together, and further defining an anchor for an associated locking member.

4. The invention of claim 3 wherein said garment has sleeves, and wherein said spatially separated portions of said garment are on opposite sleeves of said garment.

5. The invention of claim 3, and further comprising first and second pouches, each adapted to be sewn to said lining to surround a respective unengaged locking member to protect the lining and prevent user discomfort.

6. A security system for preventing theft of a garment comprising:

first and second bracket members, each of which comprises first and second hinge portions having an aligned configuration and an opposed configuration, and a member having a portion defining a hinge pin for hingedly fastening said first and second hinge portions together, and further having a portion defining an anchor element; and locking means adapted to lock the anchor elements of said first and second bracket members together so that said garment may be secured to a fixed structure by locking said anchor elements so that said garment forms a closed loop around said fixed structure.

7. The invention of claim 6 wherein said garment has sleeves, and wherein said spatially separated portions of said garment are on opposite sleeves of said garment.

8. The invention of claim 6 wherein said garment is a fur garment comprising a skin and a lining, wherein said mounting means comprises first and second bracket members adapted to be sewn to said skin.

* * * * *